United States Patent [19]

Neilsen

[11] 4,448,051

[45] May 15, 1984

[54] KEY RETAINING DEVICE

[76] Inventor: Hildaur L. Neilsen, 2 Juniper St., Metuchen, N.J. 08840

[21] Appl. No.: 345,722

[22] Filed: Feb. 4, 1982

Related U.S. Application Data

[63] Continuation-in-part of Ser. No. 322,265, Nov. 17, 1981.

[51] Int. Cl.[3] ..... E05B 11/00; E05B 73/00

[52] U.S. Cl. ..... 70/389; 70/19

[58] Field of Search ..... 70/19, 63, 389, 441, 70/456 R; 194/51, 59, 65

[56] References Cited

U.S. PATENT DOCUMENTS

| | | | |
|---|---|---|---|
| 1,934,319 | 11/1933 | Newbauer | 70/63 |
| 3,636,742 | 1/1972 | Raney | 70/63 |
| 3,695,067 | 10/1972 | Bays | 70/63 |
| 3,708,032 | 1/1973 | Suzuki | 70/389 |
| 3,712,091 | 1/1973 | Parent | 70/63 |
| 3,742,741 | 7/1973 | Cahan | 70/63 |
| 3,744,281 | 7/1973 | Logue | 70/63 |
| 4,090,380 | 5/1978 | Bianco | 70/19 |
| 4,315,420 | 2/1982 | Oliver | 70/389 |
| 4,367,827 | 1/1983 | Keller | 70/389 |

FOREIGN PATENT DOCUMENTS

| | | | |
|---|---|---|---|
| 2213342 | 9/1973 | Fed. Rep. of Germany | 70/389 |

*Primary Examiner*—Robert L. Wolfe

*Attorney, Agent, or Firm*—Weingram & Klauber

[57] ABSTRACT

A key retaining device for capturing and selectively locking therein a portion of the working section of a key. When the key is locked in the device, its handle section is visible so that the presence of the key can be instantly determined without unlocking of the apparatus, yet the key cannot be removed from the device until unlocked with a master key. Retention of the key within the housing is accomplished by a resilient clamping mechanism employing a set of wedges which are resiliently urged toward the working section of the key and held there by a rachet spring. Insertion of a master key releases the ratchet spring allowing the wedges to release the key.

11 Claims, 6 Drawing Figures

KEY RETAINING DEVICE

BACKGROUND OF THE INVENTION

1. Field of the Invention

This application is a continuation-in-part of my application Ser. No. 322,265, filed Nov. 17, 1981.

This invention relates generally to systems for safeguarding keys from unauthorized use, and more specifically, relates to a key retaining device which permits a key to be prominently displayed, yet totally unavailable for use, unless released by authorized means.

2. Description of the Prior Art

There are many instances when it is desirable to leave a key proximate to the lock which it unlocks, yet to place the key in a circumstance such that it cannot be used by unauthorized personnel. An especially pertinent example arises in connection with automobile parking lots. Especially in lots with very large capacities, the tagging of ignition keys and their removal from the associated vehicle is not only time consuming but also presents a substantial logistic and clerical task. The ideal situation would be one where the parking lot attendants are able to leave keys within the vehicle, yet at the same time placing the keys in a condition such that they cannot be employed by unauthorized personnel.

Typical of further environments where such need arises is the practice of real estate brokers leaving keys on the doors of houses which are for rent or sale in a locked box wherein a key is placed totally inside the box. In this situation, an authorized real estate broker can unlock the box and gain access to the key through use of a master key so that the locked key can be used to open a door.

Various attempts have been made in the prior art to provide apparatus which will be satisfactory for use in the abovedescribed situations. Typical of these prior art apparatus are those disclosed in U.S. Patents: No. 3,636,742 issued to G. B. Ranay on Jan. 25, 1972; No. 3,695,067 issued to R. D. Bays on Oct. 3, 1972; No. 3,712,091 issued to R. J. Parent on Jan. 23, 1973; No. 3,742,741 issued to L. L. Cahan on July 3, 1973; and No. 3,744,281 issued to R. F. Logue et al on July 10, 1973. Each of these apparatus provide a means for suspending a locked box from a suitable supporting surface and means for placing a key totally inside the locked box such that the locked box can be locked by a master key and access to the locked key can be precluded. The locked boxes are openable with a master key presumably only available to authorized personnel.

Unfortunately, all of the above apparatus suffer from at least two shortcomings. First of all, it is not known whether or not a key is disposed inside one of these locked boxes unless the locked box is actually opened. This is more than an inconvenience since considerable time can be lost in determining whether or not a key is available as a result of having to open a plurality of boxes. A second shortcoming is that any of these devices can be battered or broken open without any substantial risk of damaging the key disposed therein. As a result, unauthorized personnel can essentially strong arm the locked boxes open and be presented with a perfectly usable key to the total frustration of the intended purpose of these devices.

Another device which has recently come into use in parking lots, utilizes a cylindrical body having a transverse slot into which the working portion of an ignition key may be inserted. Jaws above and below the slot are then clamped against the key portion by advancing one of the jaws axially in the body. This is effected by means of a specially shaped wrench which engages a member threadingly received into at the cylinder. Such member in turn drives the one jaw toward the opposed jaw and intervening key. While this type of device has received a degree of acceptance, it suffers from the serious deficiency that a make-shift took may be readily used to substitute for the aforementioned wrench, thereby circumventing the safeguard presumably provided by the device.

SUMMARY OF THE INVENTION

The present invention overcomes the problems and shortcomings associated with the prior art by providing a key retaining device which does not entirely enclose the retained key and which therefore permits visual inspection of the handle section of the key so that an observer instantly knows whether or not a key is engaged in the device. The present invention also totally destroys the usability of a key clamped therein if unauthorized extraction of the key is attempted in the apparently most logical manner, i.e., by grasping of the exposed handle section thereof and pulling on the same to try to remove the key. Further, the present invention assures that only an individual in possession of the authorized means of release will be able to operate the device as to gain access to a retained key.

In accordance with the foregoing, it may be regarded as an object of the present invention to, provide a key retaining device which will retain and lock a key in a position such that it is unusable unless removed by authorized personnel.

A further object of the present invention is to provide a key retaining device which captures and selectively locks therein only the working section of an inserted key, leaving the handle section thereof visible.

A still further object of the present invention is to provide a key retaining device which, upon inspection by an interested party will reveal whether or not a key is present without unlocking of the device.

Still another object of the present invention is to provide a key retaining device which, if unauthorized withdrawal of a key therefrom is attempted, will tend to result in rendering the key inoperative.

Another object of the present invention is to provide a key retaining device for capturing and selectively locking therein a variety of differently shaped and configured keys.

Yet another object of the present invention is to provide a key retaining device for capturing and selectively locking therein a key, which is suitable for manufacture in any many units as desired, each being openable by a master key.

A still additional and further object of the present invention is to provide a key retaining device which is simple in design, relatively inexpensive to manufacture, rugged in construction, durable, easy to operate, and efficient in operation.

Now in accordance with the present invention, the foregoing objects, as well as further objects as will become apparent in the course of the ensuing specification, are achieved in a key retaining device which interacts with a key as to capture and selectively lock therein a portion of the working section of a key having a working section and a handle section. In accordance with the present invention, a device is provided which comprises a housing having end walls and a side wall forming a chamber therein, a slot being disposed through an end wall which is in communication with the chamber and being dimensioned to accommodate therethrough a portion of the working section of the key for insertion into the chamber, and means for selectively resiliently and releasably securing the portion of the working section of the key when inserted into the chamber of the housing through the end wall of the housing, the working section of the key being held by wedges held in place by a ratchet spring which is released when a master key is inserted into the chamber.

DESCRIPTION OF ILLUSTRATIVE EMBODIMENT

The invention, both as to its organization and advantages thereof, will be explained with reference to an illustrative embodiment. However, the invention is not limited to this embodiment as other modifications thereof will be apparent to those skilled in this art, but rather, is pointed out and defined in the claims which follow this illustrative embodiment.

BRIEF DESCRIPTION OF THE DRAWING

The invention will be described in greater detail with reference to the accompanying drawings in which.

DETAILED DESCRIPTION OF THE DRAWING

Figure 1:
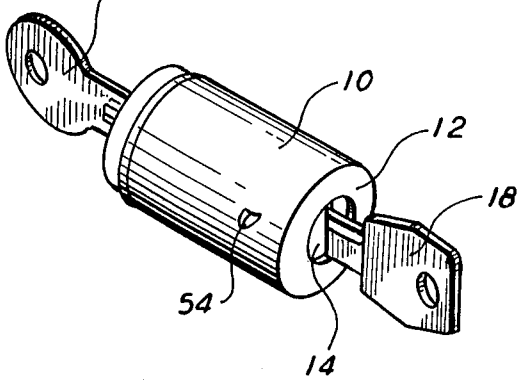
FIG. 1 is an assembly drawing of a key retaining device according to the invention.
Figure 2:
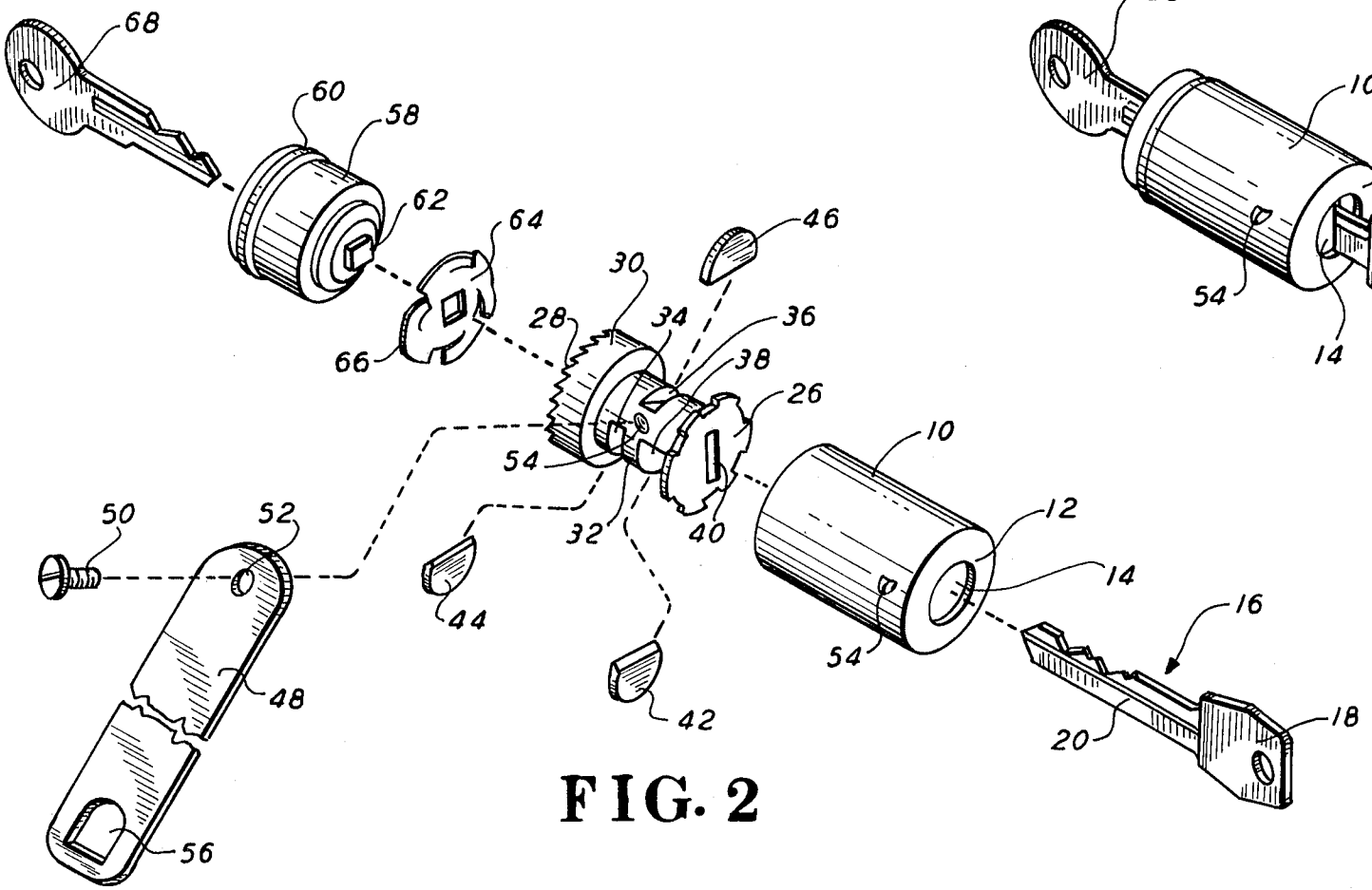
FIG. 2 is an exploded view of the said key retaining device.
Figure 3:
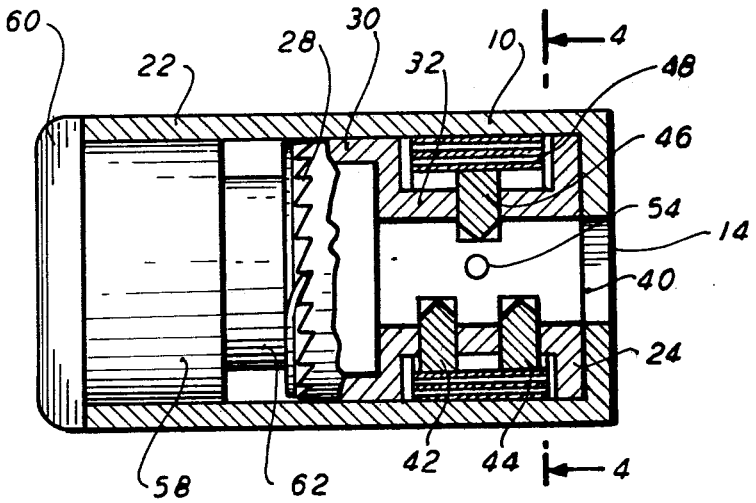
FIG. 3 is a sectional view of the device for engaging and releasably securing the working section of the key.
Figure 4:
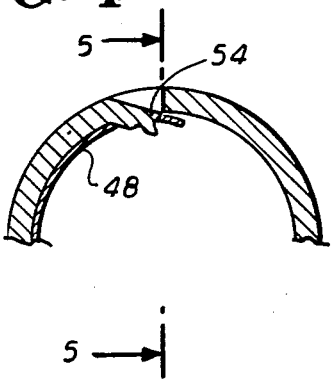
FIG. 4 is a sectional view along the lines 4—4 of FIG. 3.
Figure 5:
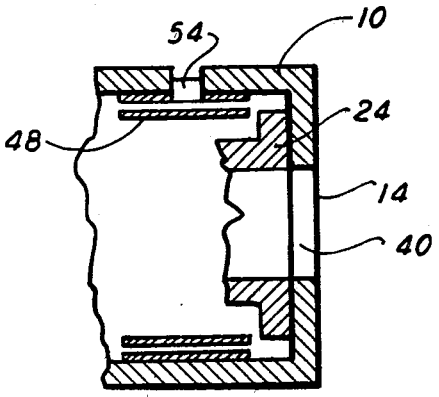
FIG. 5 is a sectional view along the lines 5—5 of FIG. 4.
Figure 6:
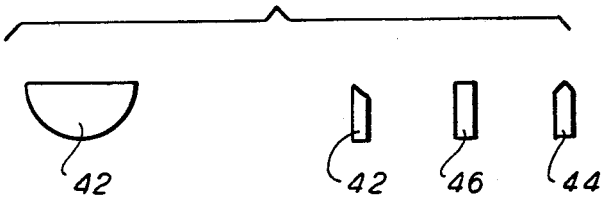
FIG. 6 shows the wedges for holding the working section of the key.

Referring to the drawing, and in particular, FIGS. 1 and 2, the key retaining device shown comprises a generally hollow cylindrical housing 10 one end of which is closed by an end-wall 12 having an opening 14 for receiving a key for an automobile, having a handle section 18 and a working or profiled, section 20.

A key-retaining mechanism 22 fits into the cylindrical housing as shown in FIG. 2. This key-retaining mechanism comprises a drum 24 having at one end a flange 26 and at the other end ratchet teeth 28 spaced around a cup-shaped end 30, and intermediate the cup-shaped end and the flange a central portion 32 of smaller diameter than either the cup-shaped end or flange. The central portion has three transverse slots 34, 36, and 38. Portion 36 is located on one side of the central portion 32 of reduced diameter, and the other two, 34 and 38, are located oppositely the first slot and spaced apart from each other.

Flange 26 has a slot 40 into working section of key 16 fits.

Three wedge-shaped members 42, 44, and 46 fit into each of the slots 34, 36, and 38, and when positioned in those slots, engage and hold the working section 20 of the key when it is inserted into slot 40 which is disposed centrally to the cylindrical axis of the drum 30.

The wedge-shaped members, which have a shape similar to a Woodruff key, are held in position by a flat spring 48 held at one end by a rivet 50 extending through a hole 52 at one end of the spring and secured in a hole 54 of the central section 32 of reduced diameter and at the other end by an internally-directed projection or boss 54 on the inner wall of housing, over which the slotted end 56 of the spring slips.

A lock (of conventional construction) is inserted securely in the other (open) end of housing 10 and has a flange 60 which abuts the open end of the housing. This lock has a base 62 to which is attached a ratchet spring 64 which has integral fingers 66 formed so as to engage ratchet teeth 28 of drum 30 in such manner as to permit the drum to be turned in one direction only.

DESCRIPTION OF OPERATION

In operation key 16 is inserted through the open end 14 of housing 10 into slot 40 of drum 30 as far as possible and turned which rotates the drum and causes spring 48, which at the inner end is fastened to the drum end at the outer end to the boss 54 to tighten up around the central portion 32 of drum 30. This causes wedges 42, 44, and 46 to be pressed inwardly, the flat ends of the wedges moving toward the center of the drum until they engage the irregular depressions (profile) in the edge of the working end of the key. They key is turned as far as possible until prevented from turning by resistance of spring 48. During this turning, the ratchet spring 64 which is in a normally locked position engages the ratchet teeth 28 and prevents the drum 30 from turning backward. The key 10 is now held by the wedges 42, 44, and 46 which engage the irregularities on the edge of the working section 20 of key 10, and the key cannot be removed unless the lock 58 holding the ratchet is released with the master key 68. The spring 48 is wound around drum 30 several times but can flex sideways as well as around the drum to accommodate the uneven position of the wedges, disposed on one side and two in the other side as they are pressed against the uneven edge of the inserted key 10 by the tightening of spring 48. The spring is held at the center of each end so that this sideways skewing to accommodate the uneven position of the wedges is possible.

To release key 10, lock 58 is opened by mounting master key 68. This permits full rotation of ratchet spring 64 and the engaged drum 30 so that the flat spring 48 unwinds and comes to rest against the inner surface of housing 10. This removes the pressure against wedges 42, 44, and 46, thus permitting key 10 to be removed.

Having thus described the invention with reference to a specific embodiment, other modification will be apparent to those skilled in the art without departing from the scope of the invention which is defined in the following claims.

What is claimed is:

1. A key retaining device for capturing and selectively locking a key having a working section and handle section comprising:

a housing having at least one end wall and a side wall and having a chamber therein;

said end wall having an opening therein communicating with said chamber and dimensioned to receive said working section of said key therethrough;

at least one wedge-like member movable radially for selectively securing said key; and means to resiliently and releasably urge said wedge-like member to engage and secure said working section of said key within said chamber.

2. A key retaining device as claimed in claim 1 wherein the wedge-like member is resiliently urged by resilient means held in position by lock means and released by insertion of a master key into said lock means.

3. A key retaining device as claimed in claim 2 wherein the resilient means includes a ratchet spring.

4. A key retaining device as claimed in claim 3 wherein the ratchet spring is mounted on a drum insertable into the other end of said housing.

5. A key retaining device as claimed in claim 4 wherein the drum has a section of reduced diameter for receiving the working section of the key, said section of reduced diameter having apertures therein for receiving the wedge-like member which is resiliently urged against the working section of the key.

6. A key retaining device as claimed in claim 5 wherein the other end of the housing, after insertion of the drum, is closed by locking means for releasably securing said ratchet means.

7. A key retaining device as claimed in claims 2, 3, 4, 5, or 6 wherein the resilient means is a flat spring secured at one end to the drum and the other end to the housing.

8. A key retaining device comprising:

(a) a hollow cylindrical housing open at one end to receive a key having a working section and a handle section which remains external to said housing;

(b) a drum member having a section of reduced diameter within said housing, said drum member having a slot at one end for receiving the working section of the key axially within the drum member;

(c) a plurality of wedge-like members moveable in slots in said drum member transverse to the working section of the keys;

(d) a toothed member at the end of said drum member remote from the head of the key;

(e) a resilient member secured at on end to the section of reduced diameter of the drum and at the other end to the inner wall of the housing;

(f) a spring member rotatable with said drum member engaging said toothed member; and (g) locking means closing the other end of said housing for securely and releasably holding said spring member in engagement with the toothed member.

9. A key retaining device as claimed in claim 8 in which said locking member is releasable with a master key, thereby releasing said spring member permitting said drum to rotate and release said wedge-like members.

10. A key retaining device as claimed in claim 9 in which the resilient member is a flat spring.

11. A key retaining device as claimed in claims 9 or 10, in which the resilient member is secured to the inner wall of the drum by a detent.

* * * * *